United States Patent [19]

Wallace

[11] Patent Number: 4,502,176

[45] Date of Patent: Mar. 5, 1985

[54] BOTTLE BRUSH/GLASS CLEANER

[76] Inventor: Mark E. Wallace, 1625 First St., Anderson, Calif. 96007

[21] Appl. No.: 439,913

[22] Filed: Jan. 24, 1983

[51] Int. Cl.[3] ..... A46B 15/00; A46B 11/06

[52] U.S. Cl. ..... 15/164; 15/104.9; 15/104.92

[58] Field of Search ..... 15/164, 165, 104.9, 15/104.92, 211-213, 244 R

[56] References Cited

U.S. PATENT DOCUMENTS

| | | | |
|---|---|---|---|
| 975,862 | 11/1910 | Hatosy | 15/164 |
| 1,083,829 | 1/1914 | Hatosy | 15/164 |
| 1,218,936 | 3/1917 | Ford . | |
| 1,781,763 | 11/1930 | Newlin . | |
| 1,975,392 | 10/1934 | Fera . | |
| 2,124,748 | 7/1938 | Ransom | 15/164 |
| 2,556,003 | 6/1951 | Sandell et al. | 15/211 X |
| 2,561,240 | 7/1951 | Spearman | 15/164 |
| 3,027,583 | 4/1962 | Bain | 15/164 |
| 4,184,222 | 1/1980 | Wootten | 15/164 |

*Primary Examiner*—Chris K. Moore

*Attorney, Agent, or Firm*—Leonard D. Schappert

[57] ABSTRACT

The present invention consists of a bottle brush/glass cleaner mounted on a base designed to fit over the center section of a double sink and, in an alternative embodiment, attached to a base having means for attachment to a substantially flat, smooth surface. In a further alternative embodiment, the bristles of the bottle brush/glass cleaner are mounted on a hollow tube which has means for connection to a water line, thereby improving the efficiency of the bottle brush/glass cleaner.

4 Claims, 7 Drawing Figures

BOTTLE BRUSH/GLASS CLEANER

BACKGROUND OF THE INVENTION

1. Field of the Invention

This invention relates generally to glass and bottle washing devices and, more specifically, to glass and bottle washing devices known as bottle brushes.

2. Description of the Prior Art

Previously, inventors have designed bottle brushes or glass washers which were mounted on metal handles and which required the user to hold a jar or glass in one hand and the bottle brush in the other, thereby making its use cumbersome. Other inventors have designed tumbler and bottle washers designed to fit inside a glass, with a provision whereby water is routed through the handleof the bottle washer and into the tumbler or bottle in the area of the bristles. Other inventions have been directed at the production of bottle brushes or glass cleaners designed to be permanently affixed for use in kitchens or restaurants. None of the prior art of which applicant is aware teaches a bottle brush/glass cleaner having the unique structure and features of the present invention.

SUMMARY OF THE INVENTION

The present invention consists of a bottle brush/glass cleaner mounted on a base designed to fit over the center section of a double sink and, in an alternative embodiment, attached to a base having means for attachment to a substantially flat, smooth surface. In a further alternative embodiment, the bristles of the bottle brush/glass cleaner are mounted on a hollow tube which has means for connection to a water line, thereby improving the efficiency of the bottle brush/glass cleaner.

One object of the present invention is to provide a bottle brush/glass cleaner which is easily attachable to the center section of a double sink, thereby enabling an individual to wash bottles, glasses and other items using one hand.

Another object of the present invention is to provide a bottle brush/glass cleaner which is easily attached to a substantially flat, smooth surface.

A further object of the present invention is to provide a bottle brush/glass which is adapted to clamp onto a water spout.

Another object of the present invention is to provide a portable bottle brush/glass cleaner which includes means for routing water up and into the bottle brush and out in the area of the bristles, thereby increasing the efficiency of persons washing glasses, bottles or other items.

Another object of the present invention is to provide an inexpensive, portable bottle brush/glass cleaner which easily attaches to the center section of a double sink and which has quick connect-disconnect means whereby the brush portion of the bottle brush/glass cleaner can easily be removed and replaced with a brush of a different size.

The foregoing objects, as well as other and further objects, will become more apparent in the following discussion of the preferred embodiments and the claims.

DESCRIPTION OF THE PREFERRED EMBODIMENTS

Figure 1:
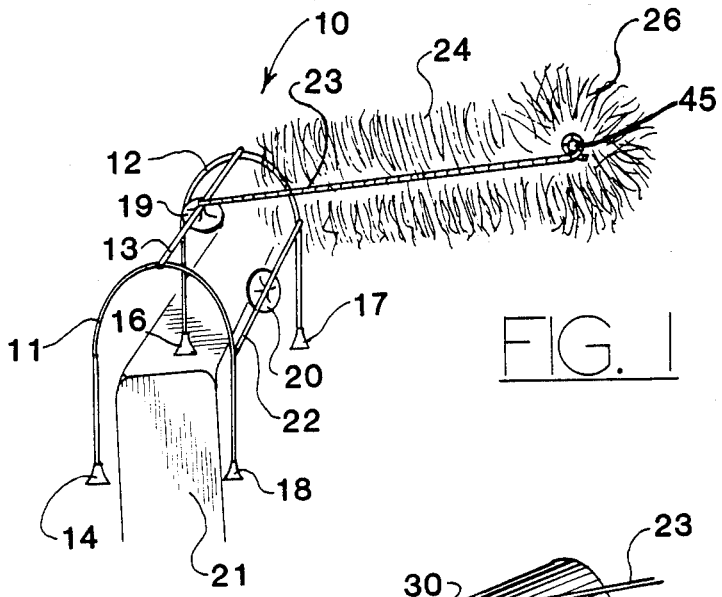
FIG. 1 is a perspective view of a complete bottle brush/glass cleaner.

FIG. 1 is a perspective view illustrating a complete bottle brush/glass cleaner constructed in accordance with the present invention. A base is constructed of two wire rods (11) and (12) bent to fit over the center section (21) of a sink and connected to each other by wire rods (13) and (22) by welding or some other appropriate means of rigid attachment. Rubber feet (14) and (16) are attached to the ends of wire rod (11), and rubber feet (18) and (17) are attached at the ends of wire rod (12). The purpose of rubber feet (14), (18), (16) and (17) is to cushion rods (11) and (12) and keep them from scratching the surface of the center section (21) of the sink. The suction cup (19) is rigidly attached to rod (13), and suction cup (20) is rigidly attached to rod (22). When both suction cups (19) and (20) are compressed, suction cup (19) against the top of center section (21) and suction cup (20) against the side of center section (21), the bottle brush/glass cleaner (10) is held substantially rigidly in place on center section (21) of the sink. A brush is provided which consists of bristles (24) and (26) mounted on rod (23). Rod (23) is rigidly attached to rod (13) halfway between the points where rod (13) attaches to rod (11) and rod (12). In this embodiment, the end of rod (23) is crimped to assist in holding bristles (26). When bottle brush/glass cleaner (10) shown in FIG. 1 is properly attached to the center section (21) of a sink, the operator can clean bottles, glasses or other items using only one hand, thereby freeing the operator's other hand.

Figure 2:
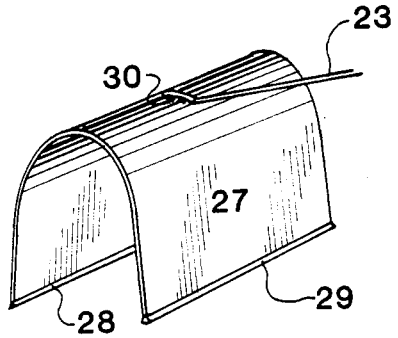
FIG. 2 is a perspective view showing alternative attachment means for use in attaching the bottle brush/-glass cleaner to the center section of a sink or similar structure.

FIG. 2 shows an alternative means of attaching bottle brush/glass cleaner (10) to the center section (21) of the sink. This means consists of a base (27) constructed of metal sheet bent to substantially fit the size of the center section (21) of the sink. Rubber runners (28) and (29) are rigidly attached to the lower edges of the sheet metal of base (27) in order to keep base (27) from scratching the sink. The suction cups (19) and (20), although not shown in FIG. 2, are placed inside base (27) in substantially the same positions they occupy in FIG. 1, thereby facilitating substantially rigid attachment of base (27) to center section (21) of the sink. Wire rod (23) is here shown attached to base (27) by weld (30).

Figure 3:
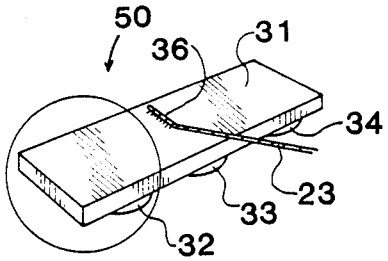
FIG. 3 is a perspective view showing a base with means for attachment to a flat, smooth surface.
Figure 3A:
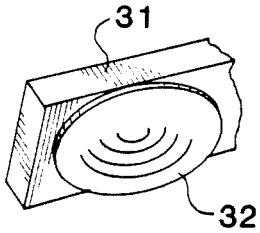
FIG. 3A is an expanded bottom view of the circled area of FIG. 3 showing the means for attachment to a substantially flat, smooth surface.

FIG. 3 shows a further alternative base for use in building the bottle brush/glass cleaner (10). This base consists of a substantially rectangular flat sheet (31), constructed of metal, plastic or some other appropriate material. Attachment means (32), (33) and (34) are designed to adhere to a substantially smooth, flat surface. In the present embodiment of base (50), attachment means (32), (33) and (34) consist of suction cups rigidly attached to the bottom surface of sheet (31), as shown in FIG. 3A. Rod (23), upon which bristles (24) and (26) are mounted, is rigidly attached to sheet (31) at point (36) through the use of a weld if sheet (31) is constructed of metal or an appropriate cement or glue if sheet (31) is constructed of a plastic material.

Figure 4:
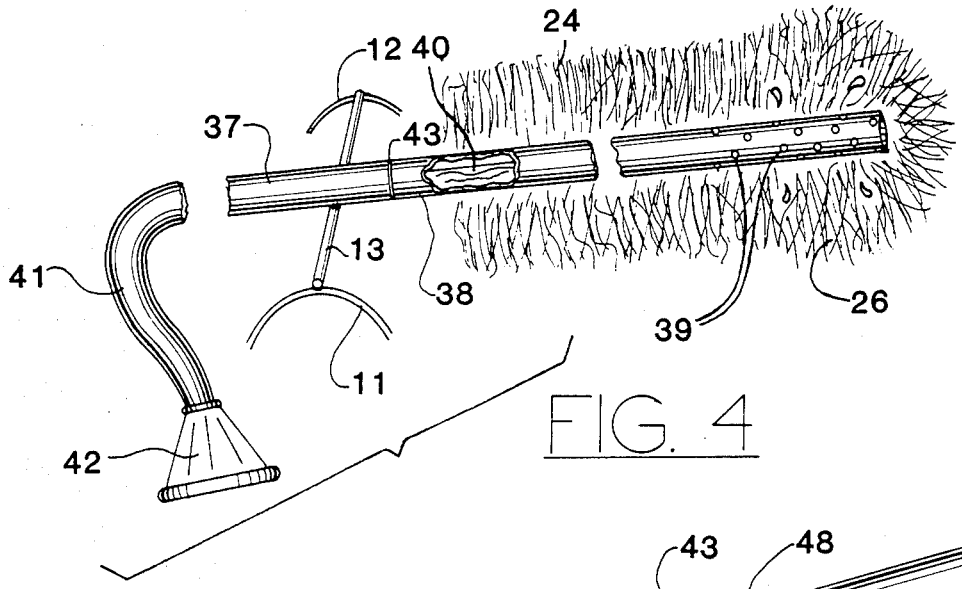
FIG. 4 is a perspective view of an alternative embodiment of the bottle brush glass cleaner showing a brush using a hollow center rod and means for delivering water to the end of the bottle brush/glass cleaner.
Figure 5:
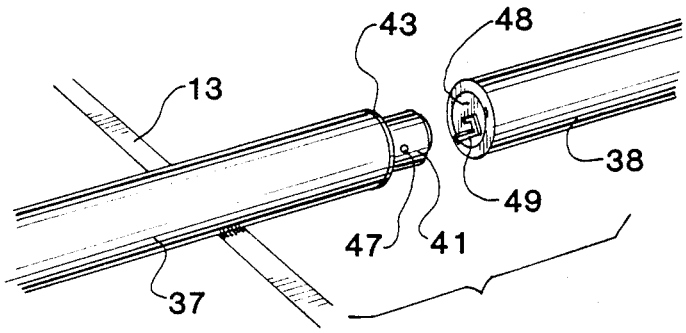
FIG. 5 is an expanded perspective view showing the quick connect-disconnect means employed to attach bottle brushes of different sizes to the base of the bottle brush/glass cleaner.
Figure 6:
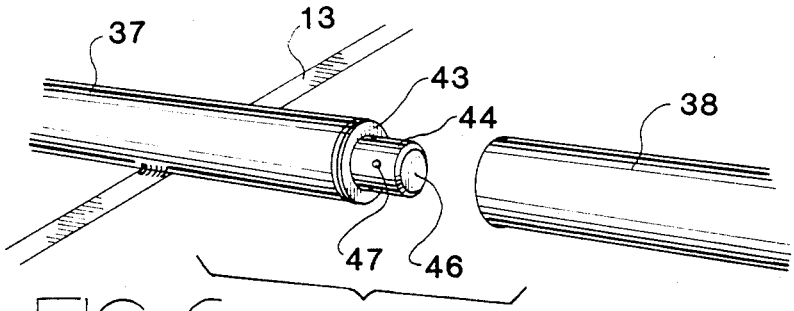
FIG. 6 is an expanded perspective view showing the quick connect-disconnect means of FIG. 5 taken from a different perspective.

FIG. 4 shows an alternative brush which has provision for routing water through rod (38) to the bristles on a continuous basis, thereby making it easier to wash bottles, glasses or other items. This alternative brush arrangement consists of a hollow rod (38) with bristles (24) and (26) mounted thereon, and having holes (39) so that water may exit rod (38) in the area of the bristles (24) and (26). While hollow rods (37) and (38) could be constructed of a single rod rigidly attached to wire rod (13), two rods are utilized to provide a method of connecting and disconnecting the brush from the base, as shown in FIGS. 5 and 6, which will be discussed later. Washer (43), shown in FIG. 4, seals and keeps the joint between rods (37) and (38) from leaking. A flexible hose (41) is attached to rod (37) and has means for attachment to a water line (42) which, in the present embodiment, is constructed of a flexible slip-fitting made of rubber or some other appropriate flexible material.

FIGS. 5 and 6 give perspective views from two directions indicating the construction of the connect-disconnect means utilized in connecting and disconnecting rod (37) to and from rod (38). Rod (37) has a nipple (41) with locking pins (47) which is designed to fit into opening (48) of the rod (38) and locking groove (49) of rod (38). Sealing means (43) are provided and consist of a rubber washer or O-ring or other appropriate means for sealing the connection.

While FIGS. 5 and 6 above were utilized to illustrate the method of connecting and disconnecting a brush having means to convey water to the end of the brush, it is applicant's intent that similar quick connect-disconnect means could be utilized with rod (23) shown in FIGS. 1, 2 or 3, thereby making it possible to use brushes of different sizes in both length and diameter with a given base, and giving the bottle brush/glass cleaner a greater degree of flexibility.

A further embodiment, not shown in the drawings, includes a bottle brush mounted on a clamp designed to attach to a water spout.

The foregoing discussion of the embodiments of the present invention has shown several alternative embodiments relating to particular aspects of the bottle brush/-glass cleaner, each having distinct advantages. While the foregoing has disclosed such alternative embodiments, these are included for illustrative purposes and for purposes of disclosing the flexibility of the present invention. It is applicant's intent not to be limited in any way by the specific nature of the foregoing description of embodiments, but only by the claims which follow.

I claim:

1. An apparatus for cleaning bottles, glasses or other items, comprising:

a base constructed of two or more rods formed to fit over the center section of a double sink or similar structure and attached to each other by at least one rod;

securing means attached to said base whereby said base securely attaches to a surface, and a brush mounted on a structural center piece rigidly attached to and extending outward from said base.

2. The invention of claim 1 wherein said securing means consist of one or more suction cups.

3. An apparatus for cleaning bottles, glasses or other items, comprising:

a base constructed of a sheet of structural material formed to fit over the center section of a double sink or similar structure;

securing means attached to said base whereby said base securely attaches to a surface, and a brush mounted on a structural center piece rigidly attached to and extending outward from said base.

4. The invention of claim 3 wherein said securing means consist of one or more suction cups.

* * * * *